United States Patent [19]

Klibofske

[11] 4,265,062

[45] May 5, 1981

[54] FOUNDATION COVERING

[76] Inventor: Virgil L. Klibofske, 1018-15th Ave. N., South St. Paul, Minn. 55075

[21] Appl. No.: 8,878

[22] Filed: Feb. 2, 1979

[51] Int. Cl.[3] ..... E04B 1/80

[52] U.S. Cl. ..... 52/97; 52/169.11

[58] Field of Search ..... 52/169.11, 169.1, 169.12, 52/169.5, 169.14, 302, 97

[56] References Cited

U.S. PATENT DOCUMENTS

| | | | |
|---|---|---|---|
| 300,861 | 6/1884 | Gilbert | 52/169.1 |
| 2,146,775 | 2/1939 | Stoutenburgh | 52/169.14 |
| 2,994,987 | 8/1961 | Klein | 52/97 |
| 3,511,005 | 5/1970 | MacMasters | 52/97 |
| 3,561,175 | 2/1971 | Best | 52/169.11 |
| 3,673,750 | 7/1972 | Bokvist | 52/169.11 |
| 3,919,815 | 11/1975 | Alabaster | 52/97 |
| 4,001,361 | 1/1977 | Unruh | 52/169.12 |
| 4,031,676 | 6/1977 | Dally | 52/102 |

*Primary Examiner*—John E. Murtagh

*Attorney, Agent, or Firm*—Jacobson and Johnson

[57] ABSTRACT

A foundation covering comprising a set of insulating blocks which when fastened end to end form a continuous protective covering over the foundation area of a building to retard heat loss and direct water or snow away from the foundation area.

3 Claims, 5 Drawing Figures

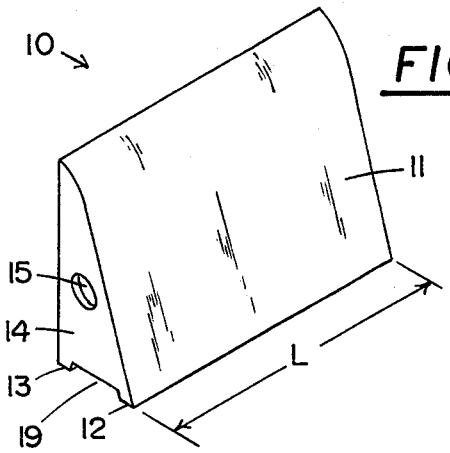
FIG. 1
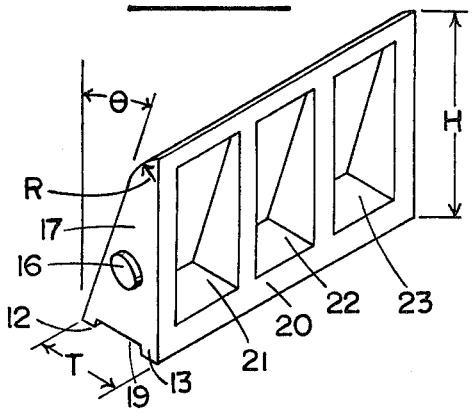
FIG. 2
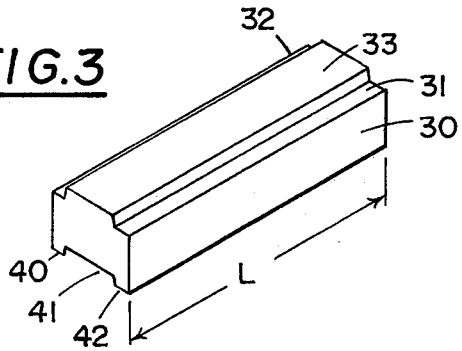
FIG. 3
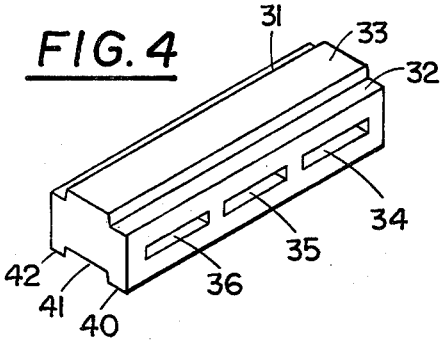
FIG. 4
FIG. 5
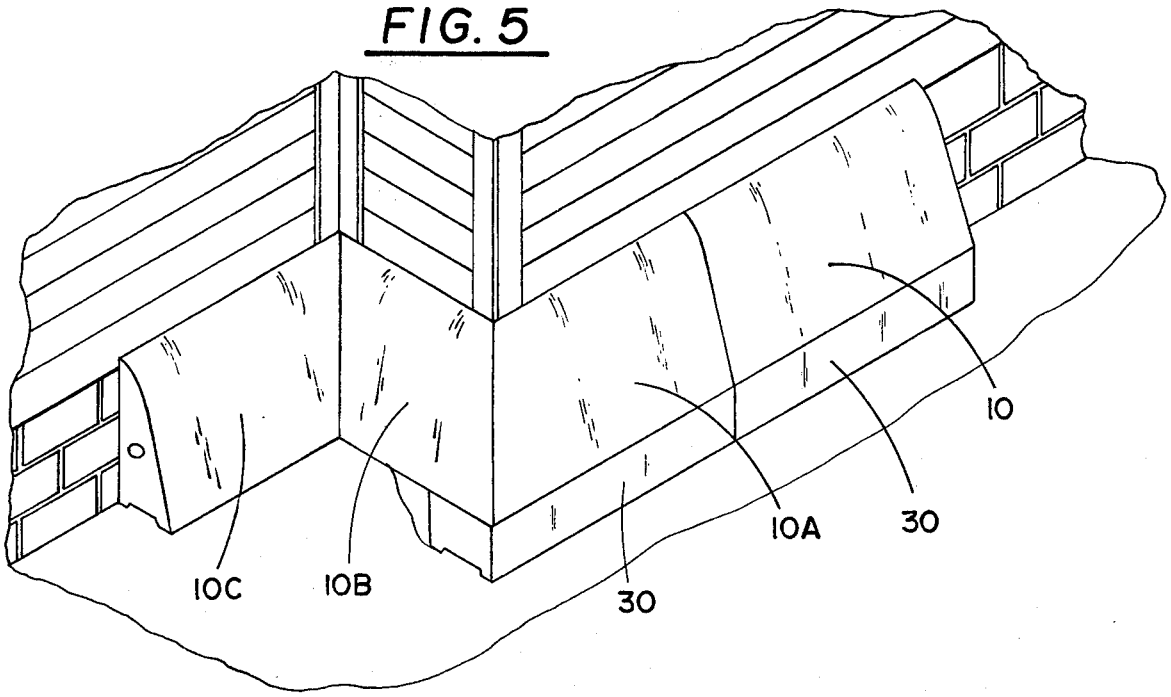

FOUNDATION COVERING

BACKGROUND OF THE INVENTION

1. Field of the Invention

This invention relates generally to foundation coverings and, more specifically, to insulating blocks that when assembled form an insulating covering on the outside of a building foundation. The blocks can be stored during the warmer months and installed on the foundation for winter use.

2. Description of the Prior Art

The concept of foundation coatings or foundation attachments are known in the art. A typical foundation attachment is shown in the Patrick U.S. Pat. No. 3,283,460. Patrick shows a permanent drainage member extended along the entire base of the basement wall to direct water away from the base of the wall.

Another type of foundation wall protective sheet is shown in the Bergsland U.S. Pat. No. 3,888,087. Bergsland shows membranes or sheets placed along the foundation wall but below grade to provide air channels along the foundation wall. The air channel provides a thermal barrier between the foundation and the surrounding surface.

A further type of foundation coating is shown in the Daimler U.S. Pat. No. 3,754,362. Daimler shows a vertical drainage system for a basement comprising a sealer coat on the outer surface of the foundation wall. The sealer coat comprises a filamentary web or sheet composed of a fiber formed synthetic thermoplastic polymer.

All of these prior art inventions address the problem of water drainage but provide very little insulating qualities. Other prior art methods of providing insulation around the exterior of foundation range from banking the foundation walls with materials such as snow, straw, hay, or manure. However, the latter materials are not very aesthetic. In contrast, the present invention provides both an insulating and a protective covering formed of free-standing blocks located outside the foundation wall region and above the grade level. The blocks not only provide insulation but the shape directs water away from the foundation wall.

BRIEF SUMMARY OF THE INVENTION

Briefly, the present invention comprises a free-standing insulating block having a triangular cross section which can be mated to a similar block to form a continuous foundation covering yet can be dis-assembled and stored during the summer months.

BRIEF DESCRIPTION OF THE DRAWING

FIG. 1 is a pictorial view of the insulating block;

FIG. 2 is a rear view of the insulating block of FIG. 1;

FIG. 3 is a front view of a riser;

FIG. 4 is a rear view of the riser of FIG. 3; and

FIG. 5 shows a set of insulated blocks located around a house foundation.

DESCRIPTION OF THE PREFERRED EMBODIMENT

Referring to FIGS. 1 and 2, reference numeral 10 generally designates my insulating block which has a height designated by H, a length designated by L, an overall thickness designated by T, and a front angle designated by $\theta$. The front surface designated by reference numeral 11 extends upward at an angle $\theta$ from the front ridge 12. The top section of surface 11 curves inward at a radius R to provide a smooth transition between the front surface 11 and a foundation wall. Radiusing the top edge of block 10, one obtains a block with a top edge that will not easily break yet has a slope that directs water or snow away from the foundation wall. Typical dimensions for block are H=2', L=3', T=10", and $\theta$ approximately 15°. These dimensions have been found convenient for use with most foundations as well as providing an easily usable and storable block. In most cases, block 10 should have a minimum height of 2 feet to enable the block to cover most foundation walls with a single block.

Located on the bottom of block 10 is a channel 19 that extends the length of block between ribs 12 and 13. Ribs 12 and 13 coact to form supports so block 10 can stand by itself. Having spaced ribs has also been found to facilitate the placing of block 10 adjacent to the foundation because the ribs can be easily slid longitudinally on the ground to provide a firm footing for the free-standing block. On one end of block 11 is an end face 14 and a recess 15 and on the opposite end of block 11 (FIG. 2) is an end face 17 with a circular member 16. Circular member 16 fits snugly in recess 15 of an adjacent block to thereby hold adjacent blocks in alignment when the blocks are located along a foundation wall.

Referring to FIG. 2, block 10 has a rear section with recess members 21, 22, and 23 located in face 20. One of the purposes of recess members is to provide a cavity or space for foundation plantings, i.e. the bottom section of block 10 can be broken away allowing the foundation planting to extend in recess 21, 22, or 23.

FIG. 3 shows a riser 30 for use with my insulated block. In the event that the height of block is insufficient to extend from the ground to the siding, riser 30 can be mated to the bottom of block 10. Riser 30 can be made of various heights but preferrably has the same length as the block shown in FIG. 1. Riser 30 shown in FIG. 3 contains a top ridge 33 and channels 31 and 32 which mate with members 19, 12, and 13 of block 10. Similarly, the bottom portion of riser 30 contains ribs 40 and 42 and channel 41 which allow riser 30 to mate with additional risers if one or more risers are required. The rear portion of the riser contains relief openings 34, 35, and 36 for convenience of casting.

FIG. 5 shows a set of blocks located along the foundation of a house. The blocks are designated by reference numeral 10, 10A, 10B, and 10C. All blocks were made in the shape as shown in FIG. 1; however, in order to provide exterior and interior corners, the original shape blocks have been mitered. Block 10A and 10B have been provided with an outside miter on adjacent ends. Similarly, one end of block 10B and one end of block 10C have an inside miter to provide an inside corner. The original block has been mitered to form both the inside and outside corner on block 10B. Typically, the mitering can be done by a homeowner. If the blocks are made from an insulating material such as expanded polystyrene, a sharp knife or saw can be used to miter the blocks. Located beneath blocks 10 and 10A are risers 30. While the preferred material for insulating block is a polymer plastic such as expanded polystyrene, other insulating materials may also be suitable for use in my invention.

If desired, blocks 10 can be installed permanently by applying an adhesive to the ends of the assembled blocks. Similarly, if desired, the risers can be bonded to the block.

In certain applications it may be necessary to hold the block against the foundation by use of pegs or the like located at the base of the blocks. The pegs such as tent stakes can easily be removed yet firmly hold the block against the foundation wall.

While the blocks have been shown applied to a foundation wall, my blocks can also be used where no foundation wall exists such as in storage buildings, mobile homes, or cabins. In this case the blocks are applied to the region of the building adjacent the ground which is referred to as the foundation area even though no foundation wall may be present.

I claim:

1. An above-ground foundation covering to provide a continuous insulating layer around the perimeter of a building foundation area comprising:

a free-standing insulating block, said free-standing insulating block having a cross section that is generally in the form of a right triangle, said free-standing insulating block having a base for supporting said free-standing insulating block in an upright position along a foundation area, said free-standing insulating block having a top section with a radiused edge, a front surface on said free-standing insulating block connecting said top section to said base to provide a surface for directing rain or snow away from the foundation area, said free-standing insulating block having a back side for placing against a foundation area, said free-standing insulating block having means on said base to permit positioning said free-standing insulating block upright by a foundation wall, said free-standing insulating block having a pair of ends with each of the ends having means for engaging another free-standing insulating block to thereby permit the end of a first free-standing insulating block to be assembled to the end of a second free-standing insulating block to thereby enable the assembled free-standing insulating blocks to form a continuous insulated region around the above-ground foundation of a building without attachment to the foundation area, said free-standing insulating block made from an insulating material to thereby retard loss of heat from the foundation wall, said means for engaging another free-standing insulating block operable to permit the disassembly of said free-stading insulating block for storage.

2. The invention of claim 1 wherein said front surface of said free-standing insulating block forms an angle $\theta$ of approximately 15° with respect to a vertical and said free-standing insulating block has a minimum height of two feet to enable said free-standing insulating block to extend completely over the exposed foundation area of most buildings.

3. The invention of claim 1 including an insulating riser for engaging said base of said free-standing insulating block and wherein said means on one end of said free-standing insulating block includes a male member and said means on the opposite end includes a female member so that when two free-standing insulating blocks are placed end to end the male member of one free-standing insulating block engages the female member of the adjacent free-standing insulating block to prevent lateral displacement of said free-standing insulating block with respect to each other.

* * * * *